United States Patent [19]

Yagishita et al.

[11] 4,362,801

[45] Dec. 7, 1982

[54] COPPER PHTHALOCYANINE PHOTOSENSITIVE MATERIAL FOR ELECTROPHOTOGRAPHY WITH BINDER AND AN OXADIAZOLE

[75] Inventors: Teruo Yagishita, Yokohama; Seiji Okada, Kawasaki; Toshiaki Narusawa; Hirofumi Okuyama, both of Sagamihara, all of Japan

[73] Assignee: Fujitsu Limited, Kawasaki, Japan

[21] Appl. No.: 310,277

[22] Filed: Oct. 9, 1981

[30] Foreign Application Priority Data

Oct. 16, 1980 [JP] Japan ..... 55-144988

[51] Int. Cl.[3] ..... G03G 5/06

[52] U.S. Cl. ..... 430/83; 430/96

[58] Field of Search ..... 430/83, 96

[56] References Cited

U.S. PATENT DOCUMENTS

| | | | |
|---|---|---|---|
| 3,816,118 | 6/1974 | Byrne | 430/96 X |
| 3,899,329 | 8/1975 | Bean et al. | 430/96 X |
| 4,218,528 | 8/1980 | Shimada et al. | 430/96 X |

*Primary Examiner*—Roland E. Martin, Jr.

*Attorney, Agent, or Firm*—Staas & Halsey

[57] ABSTRACT

A photosensitive material for electrophotography having an improved photosensitivity is provided, which comprises copper phthalocyanine as a photoconductor, 2,5-bis(4'-diethylaminophenyl)-1,3,4-oxadiazole as a charge transport material and a binder resin in which said photoconductor and charge transport material are dispersed. The content of the binder resin is 50 to 70% by weight based on the total amount of the photosensitive material and the weight ratio of copper phthalocyanine to 2,5-bis(4'-diethylaminophenyl)-1,3,4-oxadiazole is in the range of from 2.5 to 6.5.

2 Claims, 2 Drawing Figures

COPPER PHTHALOCYANINE PHOTOSENSITIVE MATERIAL FOR ELECTROPHOTOGRAPHY WITH BINDER AND AN OXADIAZOLE

BACKGROUND OF THE INVENTION (1) Field of the Invention

The present invention relates to a photosensitive material having a high sensitivity. More particularly, it relates to a photosensitive material which has a high photosensitivity to rays having a wave length included in the semiconductor laser oscillation wave length region and is valuable as a photosensitive material for a laser printer, especially a semiconductor laser printer.

(2) Description of the Prior Art

Many photosensitive materials such as Se, Se-Te, CdS, ZnO and organic photoconductors are known as the photosensitive material having a sensitivity to rays having a wave length included in the visible ray wave length region, that is, the wave length region of from 370 to 720 nm. Some of these photosensitive materials have already been used practically for electrophotographic copying machines or laser printers comprising an He-Ne laser as the beam source. However, there have hardly been known photosensitive materials having a sensitivity to rays having a wave length included in the semiconductor laser oscillation wave length region, that is, the near infrared ray wave length region, but only CdS, As-Te-Se and phthalocyanine photosensitive materials are known as such photosensitive material. However, CdS and As-Te-Se photosensitive materials are harmful and poisonous, and use of these photosensitive materials is not preferred because of occurrence of environmental pollution and also because of necessity of special consideration to maintenance of the safety in the manufacturing process. Furthermore, the As-Te-Se photosensitive material is defective in that a vacuum evaporation deposition apparatus should be used for the production thereof and the manufacturing process is complicated. Although Cds has a good photosensitivity, it is defective in that since the charging degree is low, a special charging process should be adopted.

Since a phthalocyanine pigment is cheap and very low in the toxicity, researches have heretofore been made on application of the phthalocyanine pigment to copying machines, laser printers and the like as the photosensitive material in the field of electrophotography. A phthalocyanine pigment alone cannot be used for the production of a photosensitive material because it has no film-forming property or vacuum evaporation deposition thereof is very difficult. Accordingly, a photoconductive film is ordinarily formed by dissolving or dispersing the phthalcyanine pigment together with a binder in an organic solvent to form a photoconductive coating solution or dispersion and coating the solution or dispersion at a thickness of several microns to scores of microns after drying on an electroconductive substrate by means of a doctor blade, a bar coater, a roll coater or the like.

The photosensitive film of the phthalocyanine pigment prepared according to the above-mentioned process shows a so-called induction phenomenon in which the decay just after irradiation is very small, that is, the irradiation energy is not utilized at a high efficiency. Accordingly, the sensitivity of this photosensitive film is insufficient as the photosensitive material for a copying machine for electrophotography or a laser printer, and the sensitivity to rays having a wave length included in the semiconductor laser oscillation wave length region is especially low. Therefore, this film is still insufficient as the photosensitive material.

As means for overcoming the foregoing difficulties involved in the phthalocyanine photosensitive material, Japanese Laid-Open Patent Application No. 133037/78 proposes a method in which 2,5-bis(4'-dialkylaminophenyl)-1,3,4-oxadiazole or other electron-donative compound is incorporated in a photosensitive layer comprising copper phthalocyanine in an amount of 0.01 to 5 mole % based on the copper phthalocyanine.

We made examinations on the above-mentioned phtosensitive material comprising copper phthalocyanine and 2,5-bis(4'-dialkylaminophenyl)-1,3,4-oxadiazole in combination, and to our great surprise, it has been found that when 2,5-bis(4'-diethylaminophenyl)-1,3,4-oxadiazole is incorporated in copper phthalocyanine in an amount much larger than the amount taught by Japanese Laid-open Patent Application Ser. No. 133037/78 and the proportion of the amount of a binder resin in the photosensitive material is reduced as compared with the amount taught by the Japanese patent application, unexpectedly excellent photosensitive characteristics can be obtained.

SUMMARY OF THE INVENTION

It is a primary object of the present invention to provide a photosensitive material which has a very high sensitivity to rays having a wave length included in the semiconductor laser oscillation wave length region and also has a high charge potential.

Other objects and advantages of the present invention will become apparent from the following detailed description.

In accordance with the present invention, there is provided a photosensitive material for electrophotography, which comprises copper phthalocyanine as a photoconductor, 2,5-bis(diethylaminophenyl)-1,3,4-oxadiazole as a charge transport material and a binder resin in which said photoconductor and charge transport material are dispersed, wherein the content of the binder resin is 50 to 70% by weight based on the total amount of the photosensitive material and the weight ratio of copper phthalocyanine to 2,5-bis(4'-diethylaminophenyl)-1,3,4-oxadiazole is in the range of from 2.5 to 6.5.

DETAILED DESCRIPTION OF THE PREFERRED EMBODIMENTS

The resin used as the dispersion medium in the photosensitive material of the present invention may be selected among resins having a good film-forming property and a good adhesion to a substrate. For example, various polymer resins such as polyesters, acrylic resins, polyvinyl butyral and polyurethane may be used, and from the viewpoint of the operation adaptability, thermoplastic resins are preferable to thermosetting resins.

Figure 1:
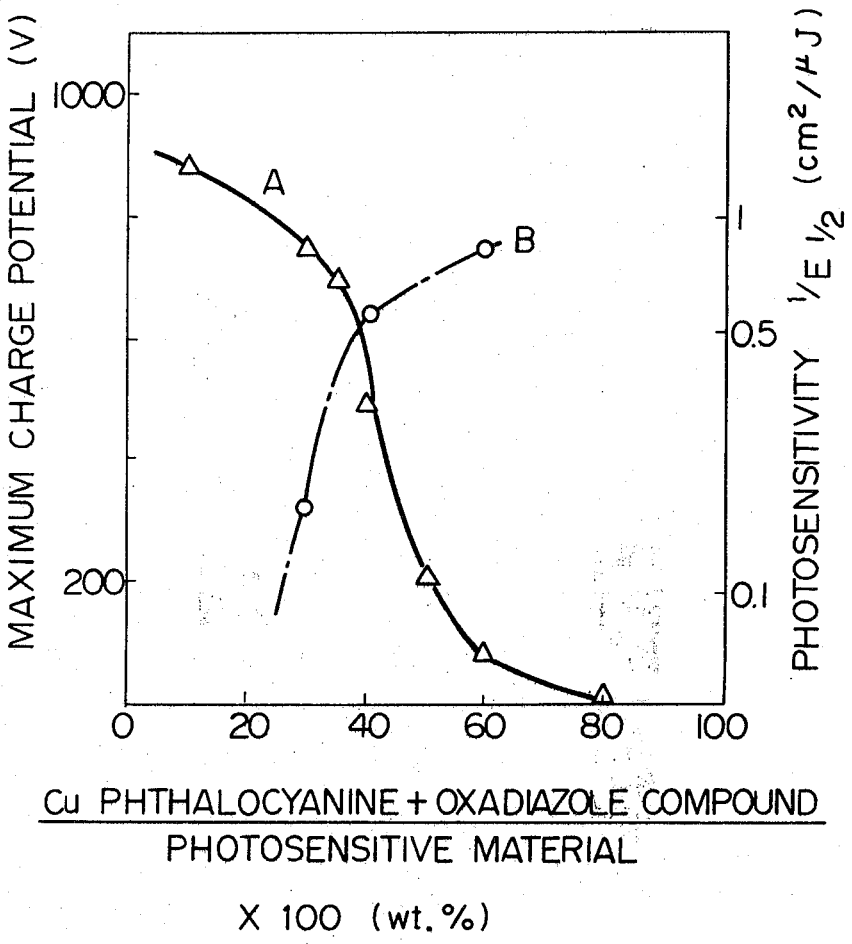
FIG. 1 is a graph showing the influences of the sum of the amounts of copper phthalocyanine and the oxadiazole compound in the photosensitive material on the maximum charge potential (curve A) and the photosensitivity (curve B)

In the present invention, it is indispensable that the amount of the binder resin should occupy 50 to 70% by weight of the total amount of the photosensitive material. More specifically, in order to obtain a relatively high charge potential, it is indispensable that the amount of lthe binder resin should be at least about 50% by weight of the total amount of the photosensitive material. Curve A in FIG. 1 shows the relation between the total content of copper phthalocyanine and oxadiazole compound the ratio of (copper phthalocyanine/the oxadiazole compound=5/1) in the photosensitive material (abscissa) and the maximum charge potential of the photosensitive material (ordinate). As is seen from this curve A of FIG. 1, if the total content of copper phthalocyanine and the oxadiazole compound is lower than about 50% by weight, that is, if the resin content is higher than about 50% by weight, the maximum charge potential is at a preferred high level. However, if the resin content in the photosensitive material is too high, though a high charge potential is obtained, transfer of charges generated in copper phthalocyanine by irradiation becomes difficult since the amount of the resin is too large, and the rate of charges escaping into the electroconductive substrate is reduced, with the result that the photosensitivity of the photosensitive material is drastically reduced. Curve B in FIG. 1 shows the relation between the total amount of copper phthalocyanine and oxadiazole compound in the photosensitive material (abscissa) and the photosensitivity (ordinate). As is seen from this curve B, if the total amount of copper phthalocyanine and oxadiazole compound is at least about 30% by weight, that is, if the resin content is not higher than about 70% by weight, the photosensitivity is at a high level intended in the present invention. Accordingly, it is indispensable that the resin content in the photosensitive material should not be higher than 70% by weight.

Copper phthalocyanine used as the photoconductor in the photosensitive material is a compound called "Phthalocyanine Blue B", which is represented by the following chemical formula:

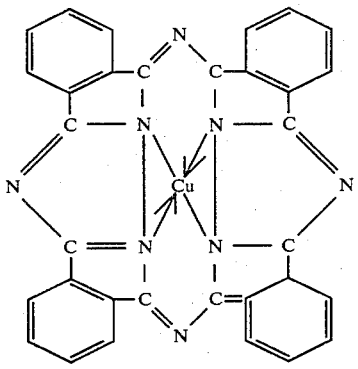

Copper phthalocyanine includes several crystal forms such as $\alpha$-form, $\beta$-form and and $\epsilon$-form, but ordinarily, $\beta$- and $\epsilon$-forms are used.

2,5-Bis(4'-diethylaminophenyl)-1,3,4,-oxadiazole that is incorporated as the charge transport material in the photosensitive material is a compound having a molecular weight of 364 and being represented by the following chemical formula:

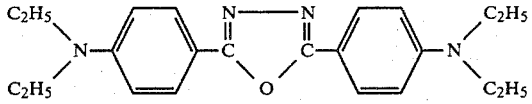

Figure 2:
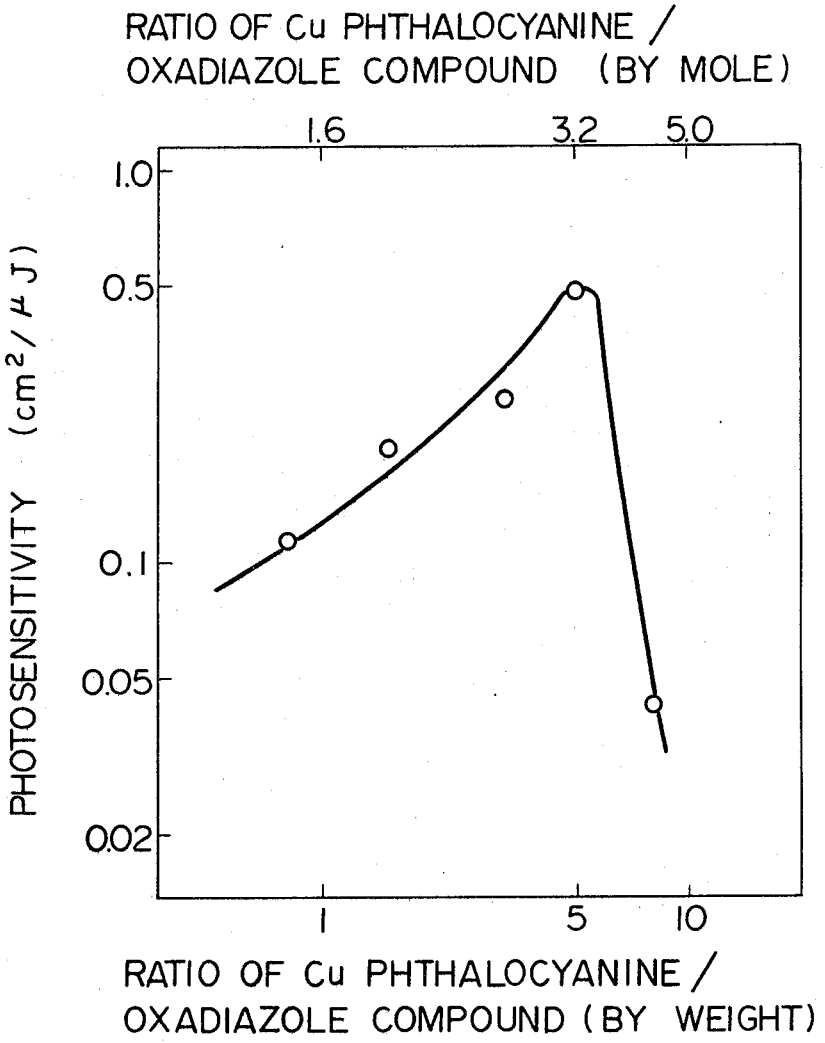
FIG. 2 is a graph showing the influences of the ratio of copper phthalocyanine to the oxadiazole compound in the photosensitive material on the photosensitivity.

In the present invention, it is indispensable that the weight ratio of copper phthalocyanine to the above-mentioned oxadiazole compound should be in the range of from 2.5 to 6.5. More specifically, as illustrated in the Example given hereinafter, when the resin content (% by weight) was kept constant and the total content of copper phthalcocyanine and the content (% by weight) of 2,5-bis(4'-diethylaminophenyl)-1,3,4,-oxadiazole (hereinafter referred to as "DEPO" for brevity) was set at [100—resin content (% by weight)], examinations were made while changing the copper phthalocyanine/DEPO weight ratio, and as the result, to our great surprise, it has been found that when the above-mentioned weight ratio has a certain value, the photosensitivity is at a highest level and if the weight ratio of copper phthalocyanine to DEPO is in the range of from 2.5 to 6.5, a high photosensitivity is obtained. The results obtained in the Examples are shown in FIG. 2, in which the relation between the weight ratio of copper phthalocyanine to DEPO (abscissa) and the photosensitivity (ordinate) is illustrated. It is preferred that this weight ratio be in the range of from 3.0 to 6.0.

The photosensitive material of the present invention comprising copper phthalocyanine, the above-mentioned oxadiazole compound and the binder resin can be applied to an electroconductive substrate according to a conventional method. More specifically, an organic solvent such as tetrahydrofuran, toluene or xylene is added to the photosensitive material of the present invention, and the resulting mixture is sufficiently blended by means of a ball mill or the like to form a coating dispersion having a viscosity of 30 to 100 cP. Then, the dispersion is coated on an electroconductive substrate at a thickness of 5 to 30$\mu$ after drying by means of a doctor blade, a bar coater, a roll coater or the like and the coated substrate is then dried.

The present invention will now be described in detail with reference to the following Example that by no means limits the scope of the invention.

EXAMPLE

A composition shown in Table 1 was charged in a polyethylene wide-mouthed bottle having an inner volume of 2 liters and was milled for 80 hours by using 600 g of alumina balls. The resulting coating dispersion was coated on an aluminum plate at a thickness of 8.0 $\mu$m after drying according to the doctor blade coating method, and the coated aluminum plate was then dried.

Each of the so-obtained photosensitive materials was charged by a corona discharge device (the discharge voltage was +6.8 KV), and the surface potential was photo-decayed from +300 V. The irradiation wave length was 760 nm and the irradiation intensity was 10 $\mu W/cm^2$. The half-value exposure quantity was measured and the photosensitivity was determined with respect to each photosensitive material. The obtained results are shown in Table 1. Furthermore, data obtained with respect to samples A, B, C, D and E shown in Table 1 are illustrated in FIG. 2. As is seen from FIG. 2, at the copper phthalocyanine/the oxadiazole compound weight ratio of about 5.0, the photosensitivity was highest. At this time, the half-value exposure quantity ($E_{\frac{1}{2}}$) was 2 $\mu J/cm^2$.

TABLE 1

| | Samples | | | | | | | |
|---|---|---|---|---|---|---|---|---|
| | A[5] | B[5] | C | D | E[5] | F[5] | G[5] | H[5] |
| β-Type copper phthalocyanine[1] (g) | 17.8 | 24.6 | 30.5 | 33.3 | 35.5 | 40 | 9 | 9 |
| Oxadiazole compound[2] (g) | 22.2 | 15.4 | 9.5 | 6.7 | 4.5 | 0.0252 | 0.0061 | 0.293 |
| Polyester resin[3] (g) | 60 | 60 | 60 | 60 | 60 | 60 | 45 | 45 |
| Tetrahydrofuran (ml) | 1000 | 1000 | 1000 | 1000 | 1000 | 1000 | 600 | 600 |
| Photosensitivity[4] $1/(E_{\frac{1}{2}})$ | 0.102 | 0.2 | 0.275 | 0.5 | 0.043 | 0.06 | 0.05 | 0.045 |

Note
[1]"Lionol Blue SN" supplied by Toyo Ink K.K.
[2]2,5-bis(4'-diethylaminophenul)-1,3,4,-oxadiazole
[3]"Polyester Adhesive #49000" supplied by DuPont
[4]The photosensitivity is expressed by the reciprocal number [$1/E_{\frac{1}{2}}$)] of the half-value exposure quantity ($E_{\frac{1}{2}}$)
[5]Comparative examples outside the scope of the present invention

We claim:

1. A photosensitive material for electrophotography, which comprises copper phthalocyanine as a photoconductor, 2,5-bis(4'-diethylaminophenyl)-1,3,4-oxadiazole as a charge transport material and a binder resin in which said photo-conductor and charge transport material are dispersed, wherein the content of the binder resin is 50 to 70% by weight based on the total amount of the photosensitive material and the weight ratio of copper phthalocyanine to 2,5-bis(4'-diethylaminophenyl)-1,3,4-oxadiazole is in the range of from 2.5 to 6.5.

2. A photosensitive material for electrophotography according to claim 1 wherein the weight ratio of copper phthalocyanine to 2,5-bis(4'-diethylaminophenyl)-1,3,4-oxazole is in the range of from 3.0 to 6.0.

* * * * *